US010398627B2

(12) United States Patent
Kriheli

(10) Patent No.: US 10,398,627 B2
(45) Date of Patent: Sep. 3, 2019

(54) NEEDLE VALVE AND CONNECTORS FOR USE IN LIQUID TRANSFER APPARATUSES

(71) Applicant: Equashield Medical Ltd., Tefen Industrial Park (IL)

(72) Inventor: Marino Kriheli, Tel-Aviv (IL)

(73) Assignee: Equashield Medical Ltd., Tefen Industrial (IL)

( * ) Notice: Subject to any disclaimer, the term of this patent is extended or adjusted under 35 U.S.C. 154(b) by 292 days.

(21) Appl. No.: 15/510,875

(22) PCT Filed: Sep. 7, 2015

(86) PCT No.: PCT/IL2015/050898
§ 371 (c)(1),
(2) Date: Mar. 13, 2017

(87) PCT Pub. No.: WO2016/042544
PCT Pub. Date: Mar. 24, 2016

(65) Prior Publication Data

US 2017/0258682 A1 Sep. 14, 2017

(30) Foreign Application Priority Data

Sep. 18, 2014 (IL) ..... 234746

(51) Int. Cl.
*A61J 1/20* (2006.01)

(52) U.S. Cl.
CPC ..... *A61J 1/2048* (2015.05); *A61J 1/201* (2015.05); *A61J 1/2013* (2015.05); *A61J 1/2037* (2015.05);
(Continued)

(58) Field of Classification Search
CPC ..... A61J 1/2048; A61J 1/201; A61J 1/2013; A61J 1/2037; A61J 1/2055; A61J 1/2062; A61J 1/2096
See application file for complete search history.

(56) References Cited

U.S. PATENT DOCUMENTS

| | | | | |
|---|---|---|---|---|
| 3,946,732 | A | 3/1976 | Hurscham | |
| 2013/0006211 | A1 | 1/2013 | Takemoto | |
| 2016/0058667 | A1* | 3/2016 | Kriheli | A61J 1/2096 604/414 |

FOREIGN PATENT DOCUMENTS

| | | | |
|---|---|---|---|
| CN | 101500632 | A | 8/2009 |
| CN | 202724368 | U | 2/2013 |

(Continued)

OTHER PUBLICATIONS

Patent Cooperation Treaty, International Search Report, International Patent Application No. PCT/IL2015/050898, dated Nov. 30, 2015, 3 Pages.

(Continued)

*Primary Examiner* — Philip R Wiest
(74) *Attorney, Agent, or Firm* — Fenwick & West LLP

(57) ABSTRACT

The invention is a needle valve comprising at least one hollow needle and a seat. The hollow needle is comprised of a smooth surfaced hollow shaft and a port adapted to allow fluid communication between the interior and the exterior of said needle located in the side of the shaft at the distal end close to the tip of said needle. The seat comprises at least one bore adapted to accommodate one of the at least one needles through it. The needle and the bore can move one relatively to the other and the bore is provided in, or is fitted with, resilient material such that the outer diameter of the needle is greater than the inner diameter of at least part of the bore. As a result the passage of the shaft of the needle in the bore creates a closely-matched shaft and sheath, which blocks the passage of fluid through the port.

7 Claims, 16 Drawing Sheets

(52) U.S. Cl.
CPC ..... *A61J 1/2055* (2015.05); *A61J 1/2062* (2015.05); *A61J 1/2096* (2013.01)

(56) References Cited

FOREIGN PATENT DOCUMENTS

| | | | |
|---|---|---|---|
| IL | 224630 | | 2/2013 |
| JP | 2010-524626 | A | 7/2010 |
| JP | 2010-537900 | A | 12/2010 |
| WO | WO 84/04673 | | 12/1984 |
| WO | WO 2007/015233 | A1 | 2/2007 |
| WO | WO 2008/129550 | A2 | 10/2008 |
| WO | WO 2009/029010 | A1 | 3/2009 |
| WO | WO 2014/064100 | A1 | 5/2014 |
| WO | WO 2014/122643 | A1 | 8/2014 |
| WO | WO 2014/181320 | A1 | 11/2014 |

OTHER PUBLICATIONS

Patent Cooperation Treaty, Written Opinion of the International Searching Authority, International Patent Application No. PCT/IL2015/050898, dated Nov. 30, 2015, 5 Pages.
Patent Cooperation Treaty, International Preliminary Report on Patentability, International Patent Application No. PCT/IL2015/050898, dated Dec. 13, 2016, 10 Pages.
Extended European Search Report, European Patent Application No. 15841478.6, dated Mar. 26, 2018, 8 pages.
First Office Action, Chinese Patent Application No. 201580050525.9, dated Mar. 1, 2019, 13 pages.
Japanese Office Action, Japanese Patent Application No. 2017-514807, dated May 14, 2019, 5 pages.

* cited by examiner

Prior Art

NEEDLE VALVE AND CONNECTORS FOR USE IN LIQUID TRANSFER APPARATUSES

FIELD OF THE INVENTION

The invention relates to valves for controlling the flow of liquids or gases. In particular the invention relates to valves used to control the flow of liquids or gases in drug transfer systems.

BACKGROUND OF THE INVENTION

Advances in medical treatment and improved procedures constantly increase the need for improved valves and connectors. The demands relating to variety of types, quality, needle safety, microbial ingress prevention and leak prevention are constantly growing. Additionally, advances in sampling or dose dispensing technologies, automated and manual, aseptic or non aseptic applications, call for new safe concealing solutions for the sampling needle. One extremely demanding application exists in the field where medical and pharmacological personnel that are involved in the preparation and administration of hazardous drugs suffer the risk of being exposed to drugs and to their vapors, which may escape to the surroundings. As referred to herein, a "hazardous drug" is any injectable material the contact with which, or with the vapors of which, may constitute a health hazard. Illustrative and non-limitative examples of such drugs include, inter alia, cytotoxins, antiviral drugs, chemotherapy drugs, antibiotics, and radiopharmaceuticals, such as herceptin, cisplatinum, fluorouracil, leucovorin, paclitaxel, etoposide, cyclophosphamideand neosar, or a combination thereof, in a liquid, solid, or gaseous state.

Hazardous drugs in liquid or powder form are contained within vials, and are typically prepared in a separate room by pharmacists provided with protective clothing, a mouth mask, and a laminar flow safety cabinet. A syringe provided with a cannula, i.e. a hollow needle, is used for transferring the drug from a vial. After being prepared, the hazardous drug is added to a solution contained in a bag which is intended for parenteral administration, such as a saline solution intended for intravenous administration.

Since hazardous drugs are toxic, direct bodily contact thereto, or exposure to even micro-quantities of the drug vapors, considerably increases the risk of developing health fatalities such as skin cancer, leukemia, liver damage, malformation, miscarriage and premature birth. Such exposure can take place when a drug containing receptacle, such as a vial, bottle, syringe, and intravenous bag, is subjected to overpressure, resulting in the leakage of fluid or air contaminated by the hazardous drug to the surroundings. Exposure to a hazardous drug also results from a drug solution remaining on a needle tip, on a vial or intravenous bag seal, or by the accidental puncturing of the skin by the needle tip. Additionally, through the same routes of exposure, microbial contaminants from the environment can be transferred into the drug and fluids; thus eliminating the sterility with possibly fatal consequences.

In copending PCT Patent Application No. PCT/IL2014/050319 there is described a needle valve comprised of:

a. at least one hollow needle comprised of a smooth surfaced hollow shaft and a port located in the side of the shaft at the distal end close, to the tip of the needle, the port adapted to allow fluid communication between the interior and the exterior of the needle; and b. a seat made of rigid material, the seat comprising at least one bore adapted to accommodate one of the at least one needles through the seat;

wherein:

i. said needle can be pushed back and forth through said bore; and the outer diameter of said needle and the inner diameter of at least part of said bore are so closely matched that the presence of the shaft of said needle in said bore blocks the passage of fluid through said part of said bore.

The connector of PCT/IL2014/050319 is characterized in that the single membrane seal actuator comprises a rigid plastic needle valve seat located proximally of the membrane, the needle valve seat comprising a bore, wherein the bore is adapted to each allow the needle to be pushed back and forth through it and at least a portion of each of the bore is adapted such that fluid cannot pass through the portion when the needle is at least partially located in the bore;

wherein, the connector is configured to allow a head portion of the second fluid transfer component to enter the interior of the connector section and to allow the single membrane actuator to be pushed proximally when the membrane at its distal end is contacted by a membrane located in the head portion of the second fluid transfer component; whereupon further pushing of the membranes together causes the distal end of the needle to exit the distal end of the bore and to penetrate the membrane in the single membrane actuator and to penetrate the membrane in the head portion, thereby establishing a fluid channel via the needle between the connection port and the interior of the second fluid transfer component.

However, it has been found that, while the device described in PCT/IL2014/050319 greatly improves over the prior art, the manufacturing process and the constant quality of manufactured devices can be further significantly improved if the bore provided in the needle valve seat, which is adapted to each allow the needle to be pushed back and forth through it, is made of resilient material. This allows for greater flexibility in machining and overcomes the problems due to hole diameter variability that may result during production, which lead to less constant product parameters.

Another deficiency of the prior art is the high friction between needle to bore that requires much force to move the needle or to move the connector during connection or disconnection. This is problematic for the user.

It is therefore a purpose of the present invention to provide needle valves that overcome the above described problems.

Further purposes and advantages of this invention will appear as the description proceeds.

SUMMARY OF THE INVENTION

In one aspect the invention relates to a needle valve comprising:

a. At least one hollow needle comprised of a smooth surfaced hollow shaft and a port located in the side of said shaft at the distal end close to the tip of said needle, said port adapted to allow fluid communication between the interior and the exterior of said needle;

b. a seat comprising at least one bore adapted to accommodate one of said at least one needles through said seat;

wherein:

i. said needle and said bore can move one relatively to the other, such that said needle can be pushed back and forth through said bore, or the bore can be moved back and forth along the needle; and ii. said bore is provided in, or is fitted with, resilient material such that the outer diameter of said needle is greater than the inner diameter of at least part of said bore, such that the passage of the shaft of said needle in said bore creates a closely-matched shaft and sheath, which blocks the passage of fluid through said part of said bore.

In one embodiment of the invention the seat or part of it is made of resilient material such as for example silicone or rubber, or made of soft plastic material, such as, for example, soft PVC. The needle valve can comprise in one embodiment a lubricant for reducing the friction between the needle and the seat.

In another embodiment of the invention the bore has a diameter greater than that of the needle and a sleeve of resilient material is fitted in said bore thereby reducing its diameter to one smaller that the outer diameter of said needle shaft. The sleeve can be made of any suitable pharmaceutically-acceptable material, such as for example silicone or rubber.

BRIEF DESCRIPTION OF THE DRAWINGS

FIGS. 1 through 3*b* schematically illustrate a prior art apparatus;

FIG. 4*a* through 15 illustrate the apparatus of PCT/IL2014/050319;

FIG. 1 is a schematic cross-sectional view of a prior art apparatus for transferring hazardous drugs;

FIG. 3*a* and FIG. 3*b* are cross-sectional views that schematically show the concept of using the apparatus of FIG. 1 for transferring hazardous drugs;

FIG. 4*a*, FIG. 4*b*, and FIG. 4*c* schematically show the needle valve of the invention;

FIG. 5*a* to FIG. 8*b* are cross-sectional views that schematically show different embodiments of the needle valve of the invention;

FIG. 12 shows another embodiment of an actuator comprising another embodiment of the needle valve of the invention that could be used in the apparatus of FIG. 10*a* and FIG. 10*b;*

FIG. 14 and FIG. 15 show engineering drawings of the connectors described in FIG. 10*a* to FIG. 12;

FIG. 16 schematically illustrate a resilient sleeve according to one embodiment of the invention, through which a needle can pass;

FIG. 17 schematically illustrates a double-needled valve with double resilient sleeve, according to one embodiment of the invention;

FIGS. 18 (*a* and *b*) further illustrates a needle valve in its housing and provided with the elastic membrane;

FIG. 19 illustrates how the double sleeve 303 of FIG. 17 fits into a device according to the invention;

FIG. 20 schematically shows the device of FIG. 19 interconnected state;

FIG. 21 shows a single needle connector with elastic needle valve using a sleeve like that of FIG. 16.

FIG. 22 shows engineering drawings of a connector with two needles and two sleeves, according to an embodiment of the invention; and FIG. 23 shows an engineering drawing of a connector with one needle and one sleeve, according to another embodiment of the invention.

DETAILED DESCRIPTION OF EMBODIMENTS OF THE INVENTION

In order to facilitate the understanding of the present invention it is convenient to describe first the invention described and claimed in PCT/IL2014/050319, since many constructive detailed that do not directly relate to the resilient channel according to the invention (which will be discussed in greater detail in the description to follow) are the same in the device according to the present invention and that of PCT/IL2014/050319. Accordingly, reference will be made occasionally to FIGS. 4 through 15, it being understood that such references are made to illustrate common features. The invention described in PCT/IL2014/050319 provides a needle valve and connectors for use in liquid transfer apparatuses that comprise the needle valve. The needle valve of PCT/IL2014/050319 is not the conventional type of needle valve known in the art that comprises a threaded valve stem, which allows very accurate control of the flow through the valve, and that uses elastic materials, such as rubber, as a sealing component. The needle valve of PCT/IL2014/1050319 comprises two components: the first component is a hollow needle having a smooth exterior surface and a port at the side of the cylindrical shaft, the second component is a seat made of rigid material e.g. plastic with low friction properties. A lubricant for further reducing the friction between the needle and the seat is desired and preferred, but the needle valve works also without a lubricant.

Figure 1:
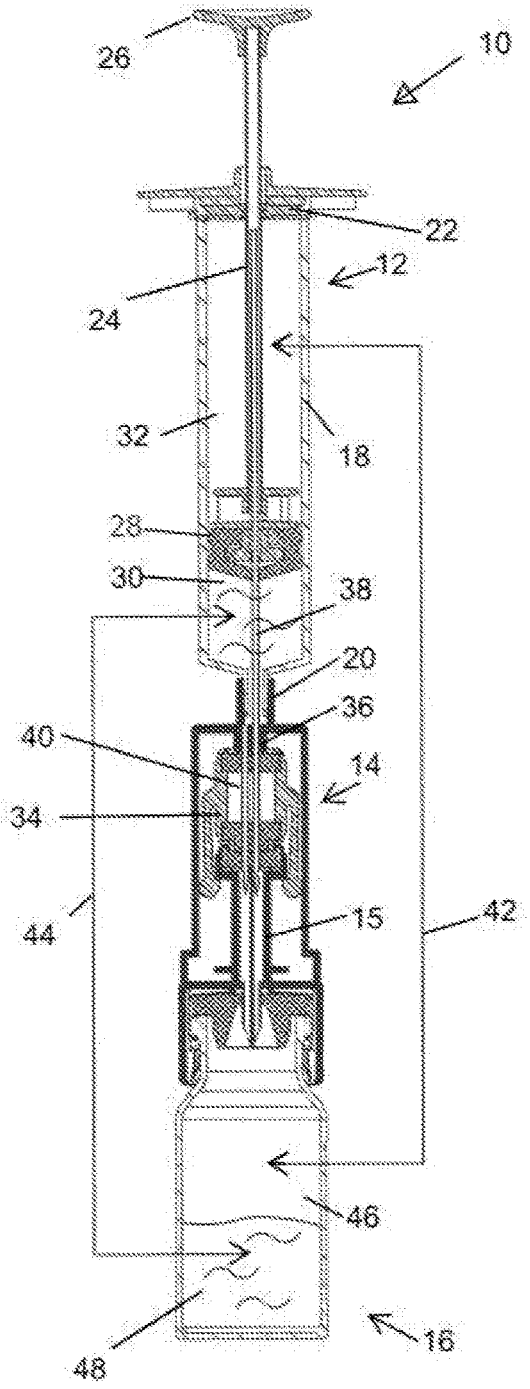
PRIOR ART Fig. 1
Figure 4A:
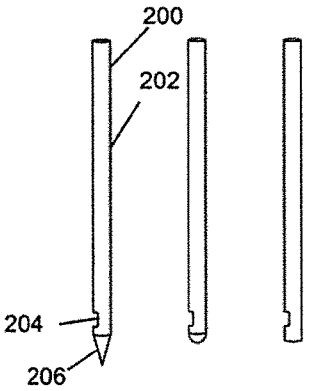

FIG. 4*a* shows three embodiments of hollow needle 200 such as needles 38 and 40 in FIG. 1. Needle 200 comprises a smooth surfaced hollow shaft 202 and a port 204 located in the side of the shaft at the distal end close to tip 206. Port 204 allows fluid communication between the interior of shaft 202 and the exterior of the shaft. Tip 206 is generally pointed as shown in FIG. 4*a*, but in embodiments of the valve the tip can have other shapes, e.g. round or flat.

Figure 4B:
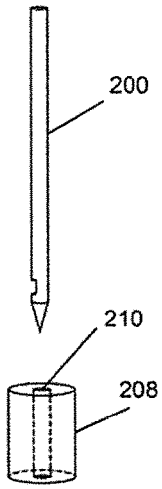

FIG. 4*b* shows the simplest embodiment of the seat 208 of the valve. In this embodiment, seat 208 is a cylindrical block of a rigid material such as acetal plastic, with a bore 210 through it.

Figure 4C:
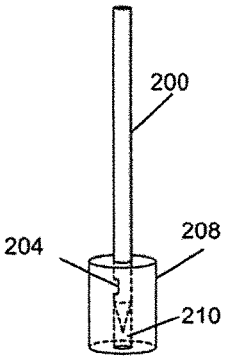

FIG. 4*c* shows the shaft of the needle inserted into the bore in the seat. The seat 208 is made of a rigid material such as acetal plastic, which has good dimensional stability and a very low coefficient of friction. This allows the valve to be manufactured with the outer diameter of needle 200 and the inner diameter of bore 210 so closely matching that, on the one hand, needle 200 can be pushed back and forth through bore 210 and, on the other hand, the presence of the shaft 202 of needle 200 in the bore 210 blocks the passage of fluid (gas or liquid) through bore 210.

FIG. 5*a* to FIG. 8*b* are cross-sectional views that schematically show different embodiments of the needle valve of PCT/IL2014/050319. Each of these figures shows two views of the valve. In the left view (labeled a) the port 204 is located within the bore 210 in the seat 208 and in the right view (labeled b) the needle has been pushed distally so that the port 204 has exited the bore 210.

In the embodiment of the valve of PCT/IL2014/050319 shown in FIG. 5*a* and FIG. 5*b* fluid communication between the outside and the interior of the shaft 202 through port 204 is blocked by the walls of the bore in FIG. 5*a* and is allowed between the space below the valve and the interior of the needle in the FIG. 5*b*. In this embodiment, no matter what the position of the port 204 relative to seat 208 there is no fluid communication between the interior of the needle and the space above the valve.

Figure 6A:
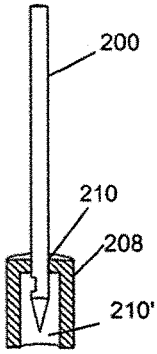
Figure 6B:
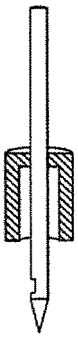

In the embodiment of the valve of PCT/IL2014/050319 shown in FIG. 6*a* and FIG. 6*b* the diameter of bore 210 in seat 208 is increased after bore 210 penetrates a short distance into seat 208 creating a chamber 210' having a much larger diameter then that of the shaft 202 of needle 200. In this embodiment bore 210 seals the shaft 202 above the port 204, thereby preventing fluid communication between the space above the valve and the interior of the needle but always allowing fluid communication between the space below the valve and the interior of the shaft 202 through port 204 is always allowed.

Figure 7A:
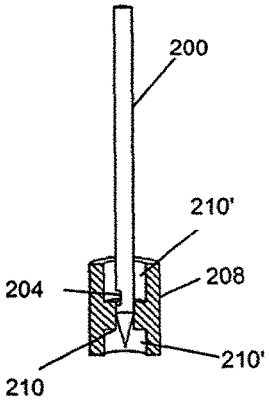
Figure 7B:
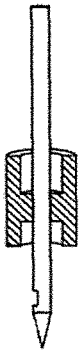

In the embodiment of the valve of PCT/IL2014/050319 shown in FIG. 7*a* and FIG. 7*b* the bore through the seat 208 is created with chambers 210' at the top and bottom and a section of the bore 210 having diameter essentially equal to that of the outer diameter of the shaft 202 of needle 200. This embodiment allows fluid communication between the space above the valve and the interior of the shaft 202 through port 204 as shown in FIG. 7*a* and between the space below the valve and the interior of the needle as shown in FIG. 7*b*.

Figure 5A:
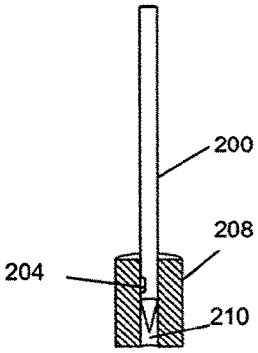
Figure 5B:
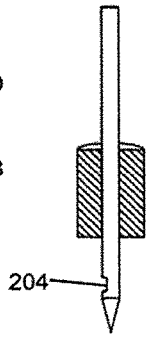
Figure 8A:
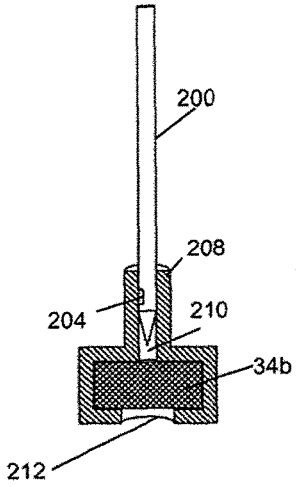
Figure 8B:
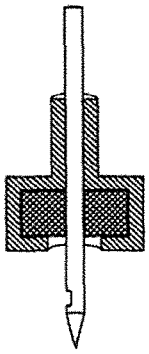

In the embodiment of the valve of PCT/IL2014/050319 shown in FIG. 8*a* and FIG. 8*b*, the valve is identical with the valve shown in FIG. 5*a* and FIG. 5*b* and in addition the bottom of the seat comprises a recess 212 into which a resilient elastic membrane 34*b* is inserted. The membrane serves as a barrier between the port 204 and the environment, preventing contaminants such as microorganisms from contaminating the bore and the needle tip retained in it, thereby maintaining sterility. On the other hand the membrane also protects the environment from hazardous substances present as residuals on the needle tip, which might be present after transfer of fluids through the needle.

Figure 9A:
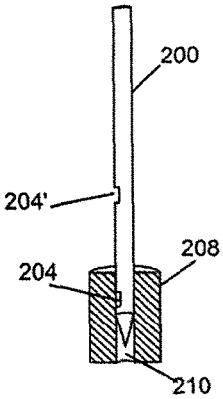
FIG. 9*a* and FIG. 9*b* schematically show an embodiment of the needle valve of the invention that comprises two ports that allow fluid communication between the outside and interior of the needle shaft.
Figure 9B:
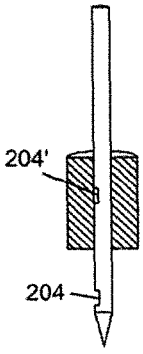

FIG. 9*a* and FIG. 9*b* schematically show an embodiment of the needle valve of PCT/IL2014/050319 that comprises two ports that allow fluid communication between the outside and interior of the needle shaft. In FIG. 9*a* port 204 is blocked by the walls of bore 210 and fluid communication between the space above the valve and the interior of the needle is allowed through port 204'. In FIG. 9*b* fluid communication between the space below the valve and the interior of the needle is allowed through port 204 while the port 204' is blocked. This embodiment of needle valve is usable in applications with more than one fluid chamber that needs to be accessed by the needle ports, such as reconstitution devices. Typically such devices have chambers for lyophilized powder and chambers for diluents. A membrane pierced by the shaft and located between port 204' and the top of seat 208 can be used to separate the multiple chambers. It is noted that embodiments of the needle valve of PCT/IL2014/050319 similar to the embodiment shown in FIG. 9*a* and FIG. 9*b* with three or more ports in the side of the needle can be produced.

Figure 9C:
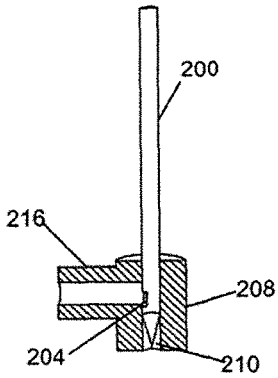
FIG. 9*c* and FIG. 9*d* schematically show an embodiment of the needle valve of the invention in which the seat of the valve comprises a side channel that allows fluid communication between the interior of the needle shaft and a remote location via the port in the side of the needle.
Figure 9D:
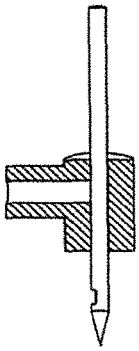

FIG. 9*c* and FIG. 9*d* schematically show an embodiment of the needle valve of PCT/IL2014/050319 in which the seat 208 of the valve comprises a side channel 216 that allows fluid communication between the interior of the needle shaft and a remote location (not shown) via the port 204 in the side of the needle 200.

The needle valve embodiments described in FIG. 4*a* to FIG. 9*d* allow a variety of uses for special needs. They allow improved designs in comparison to existing valves and connectors, improved resistance to high pressures and thereby improved general performance.

Figure 10A:
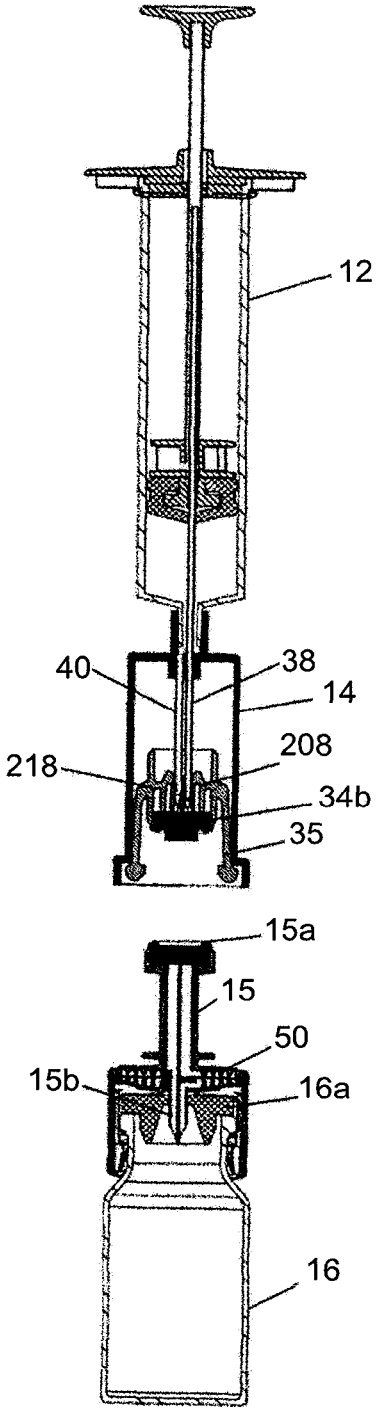
FIG. 10*a* and FIG. 11*a* are schematic cross-sectional views of an apparatus for transferring hazardous drugs identical to that shown in FIG. 1 and FIG. 2*a* respectively, with the exception that the prior art double membrane seal actuator is replaced with an actuator comprising an embodiment of the needle valve of the present invention.
Figure 10B:
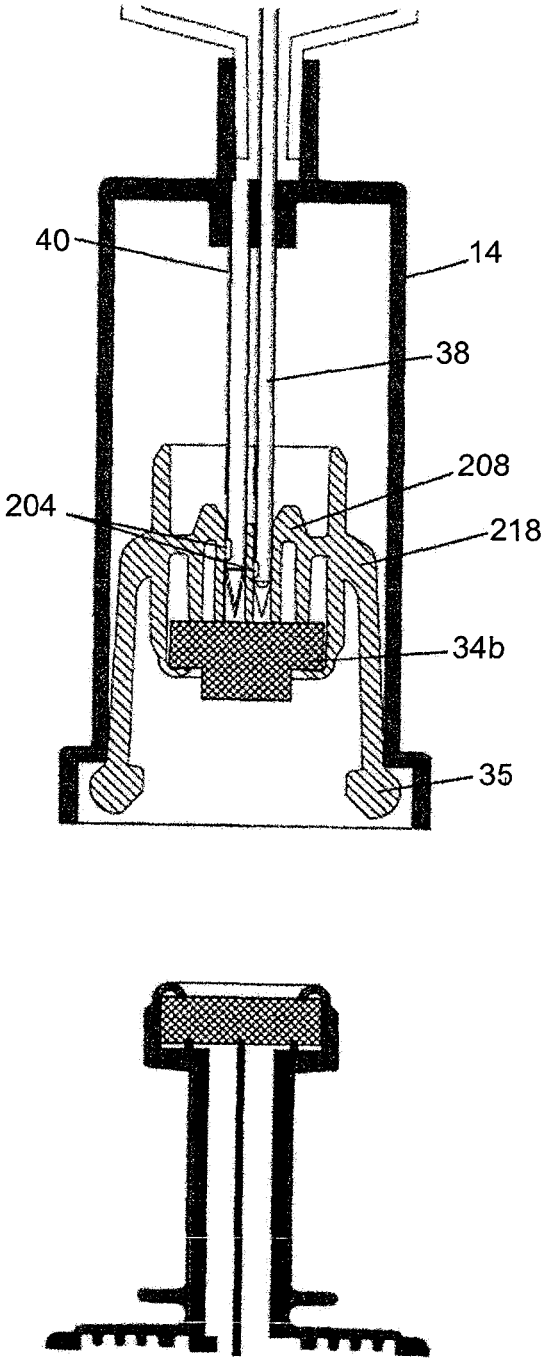
FIG. 10*b* and FIG. 11*b* are enlarged views of the actuator in the apparatus shown in FIG. 10*a* and FIG. 11*b* respectively.
Figure 11A:
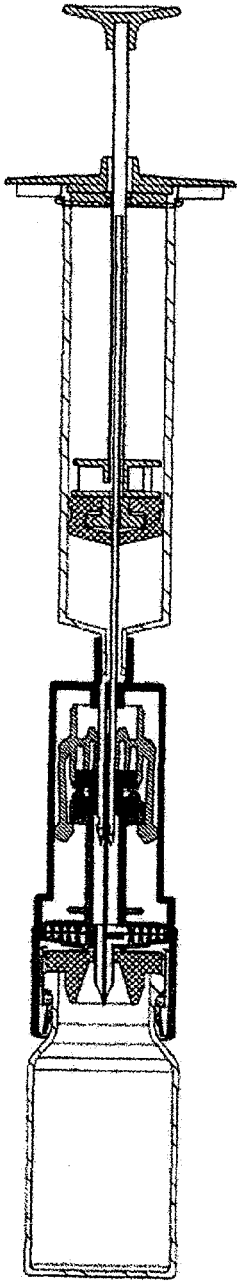

FIG. 10*a* and FIG. 11*a* are schematic cross-sectional views of an apparatus for transferring hazardous drugs. The apparatus and all of the components shown in these figures are identical to those shown in FIG. 1 and FIG. 2*a* respectively, with two exceptions. The vial adaptor 15 comprises a filter 50, as described in IL224630 and the prior art double membrane seal actuator 34 in the connector section 14 comprising two membranes 34*a* and 34*b* and arms 35 is replaced with an actuator 218 comprising an embodiment of the needle valve of PCT/IL2014/050319, only one membrane 34*b*, and arms 35. It is important to note that in all embodiments of PCT/IL2014/050319, including those shown in FIG. 10*a* through 13*b*, it is not necessary to seal the proximal end of actuator 218 in any fashion because the task of enclosing the bores 204 at the distal ends of the air and liquid conduits when the connector is not connected to another fluid transfer component, which in the prior art was accomplished by membranes 34*a* and 34*b*, is accomplished in PCT/IL2014/050319 by the needle valve arrangement and membrane 34*b* alone and in some embodiments by the needle valve itself.

Figure 11B:
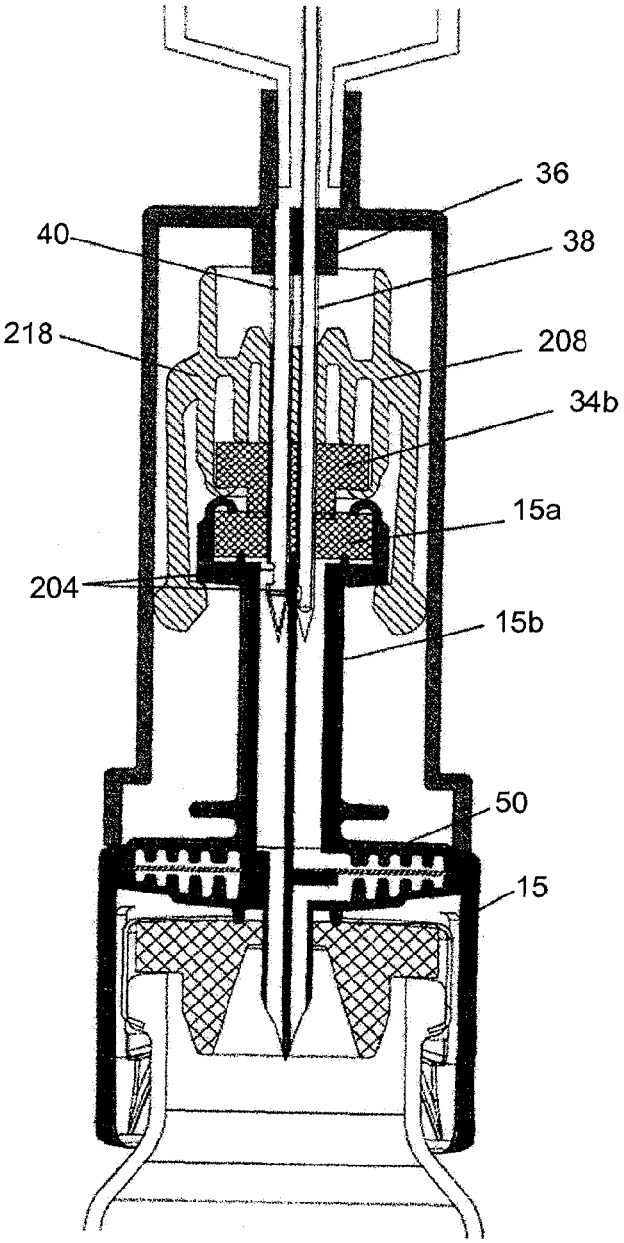

FIG. 10*a* shows syringe 12 attached to connector section 14 and vial adaptor 15 connected to drug vial 16. FIG. 11*a* shows all components of the apparatus connected together. FIG. 10*b* and FIG. 11*b* are enlarged views of the actuator in the apparatus shown in FIG. 10*a* and FIG. 11*b* respectively.

Referring to FIG. 10*b* and FIG. 11*b*, actuator 218 comprises a valve seat 208 comprising two bores through which the needles of air conduit 38 and liquid conduit 40 pass. 11 parts of the actuator (with the exception of membrane 34*b* and needles 38 and 40) are made from rigid low friction plastic, e.g. acetal, so that needles 38 and 40 slidingly fit into the bores in the seat while preventing passage of liquid or air through the bores. The diameters of the shaft and the bores require fine tuning during the product development phase, since tighter bore causes higher friction and higher pressure resistance, while less tighter bores cause less friction and moderate pressure resistance. The surface quality of the needle influences the friction, as well as the lubricant applied during the manufacture process. Materials such as acetal have excellent low friction properties and allow the valve to function even after the lubricant has been removed due to repeated connections and exposure to aggressive substances in the drugs.

When the syringe and attached connector are not connected to any other component of the apparatus, as shown in FIG. 10*b*, the actuator 218 is at the distal end of connector section 14 and the tips of needles 38 and 40 are located in the bores in the seat 208 of the needle valve. In this configuration the ports 204 in the sides of the needles are blocked by the interior walls of the bores completely isolating the needles from each other, thereby preventing air from entering the liquid chamber of the syringe or liquid from entering the air chamber even at very high pressures.

When the syringe and attached connector are connected to another component of the apparatus, such as a vial adaptor as shown in FIG. 11*b*, the actuator 218 is pushed towards the proximal end of connector section 14. Since needles 38 and 40 are fixed to the needle holder 36, as actuator 218 moves proximally, the tips of needles 38 and 40 and ports 204 are pushed out through the distal end of the bores in the seat 208 of the needle valve, through membrane 34*b*, and through membrane 15*a* of the vial adaptor, thereby establishing open fluid paths in the respective channels.

The first goal for the connector is to completely eliminate the possibility of migration of liquid to the air chamber. This can happen, for example, if pressure differentials between the air and liquid chambers exist after disconnection from a vial adaptor and if the pressure in the air chamber is lower than that in the liquid chamber, resulting in undesired migration of liquid to the air chamber. The second goal is to prevent leaks or damage to the connector during accidental pushing of the syringe plunger. One of the frequently performed drug transfer operations in hospital settings is known as IV push or bolus injection. Typically the required amount of drug is prepared in a syringe in the hospital pharmacy and delivered to the ward where a qualified nurse administers to the patient the drug through a previously established IV line. A common problem associated with the procedure is that during the trip from pharmacy to ward or at bedside the piston of the syringe is sometimes unintentionally pushed expelling some of the drug from the barrel of the syringe or unintentionally pulled, High pressures of up to 20 atmospheres can be easily generated by manually pushing the plunger of small volume syringes (1-5 ml). Such pressure may cause the connector to disintegrate or the membranes to be detached. The connector shown in FIG. 10*a* through FIG. 11*b* solves the problems associated with such unintended transfer of fluids between the air and liquid chambers and resists high pressures created during accidental pushing the of plunger. As can be seen in these figures, when the connector 14 is not connected to the adapter 15, the ports 204 at the distal end of needles 38 and 40 that allow exchange of fluid between the surroundings and the hollow interiors of the needles are blocked by the interior of the bore in seat 208 of the needle valve. If the syringe is filled or partially filled with liquid, then no matter how much force is exerted to try to push the plunger forward and to force liquid to flow through the needle, no liquid can exit the needle through port 204. Conversely, no matter how much force is exerted to pull the plunger backwards no air can enter through port 204 and flow through the interior of the needle into the barrel of the syringe.

Figure 12:
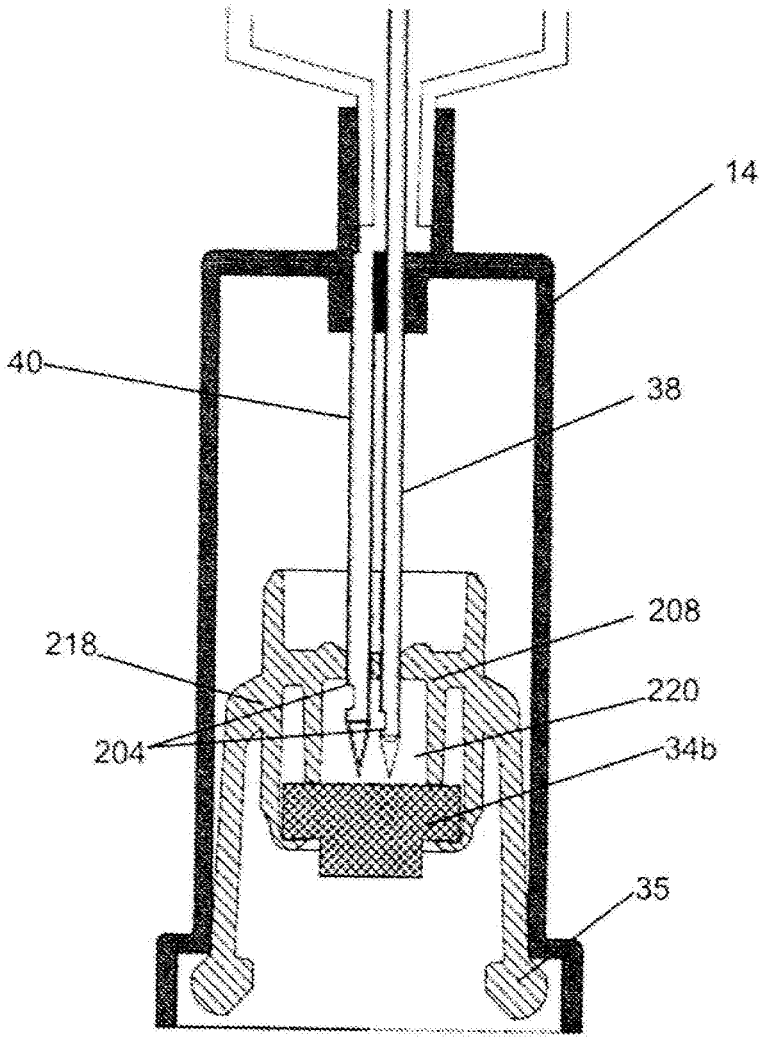

FIG. 12 shows another embodiment of an actuator 218 comprising another embodiment of the needle valve of PCT/IL2014/050319 that could be used in the apparatus of FIG. 10*a* and FIG. 10*b*. In this embodiment the seat 208 of the needle valve is constructed such that, when the syringe and attached connector are not connected to any other component of the apparatus, the actuator 218 is at the distal end of connector section 14 as shown in the figure. In this configuration the tips and the ports 204 in the sides of needles 38 and 40 are located in the enclosed space 220 between seat 208 of the needle valve and membrane 34*b*. In this configuration exchange of liquid and air can take place via the two needles.

This connector is similar to the needle valve described in embodiment shown in FIG. 6*a* and FIG. 6*b*. In this embodiment the seat 208 seals the shaft of the needles 38 and 40 above the ports 204, thereby preventing fluid communication between the environment above the actuator 218 and the interior of the space 220.

Figure 2A:
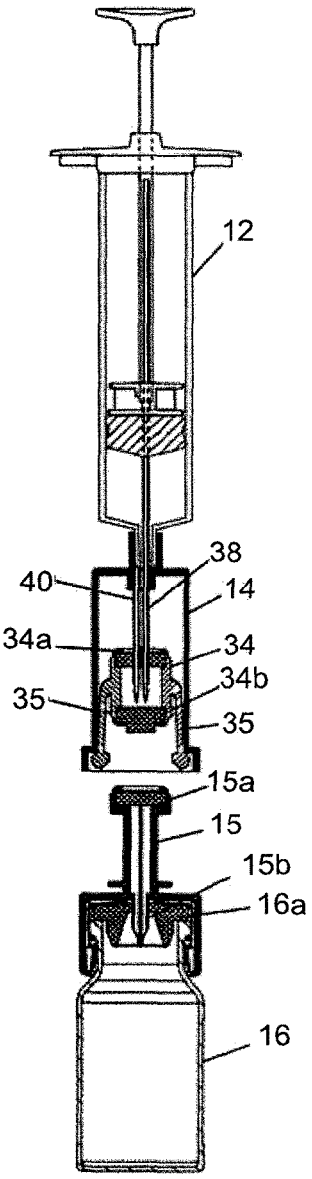
FIG. 2*a* to FIG. 2*d* are cross-sectional views that schematically show the 4 steps connection sequence between the connector section and the vial adaptor of the apparatus of FIG. 1.
Figure 2B:
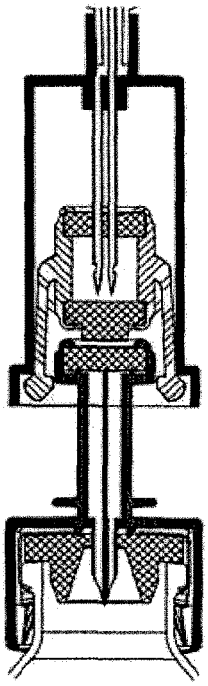
Prior Art Fig. 2b
Figure 2C:
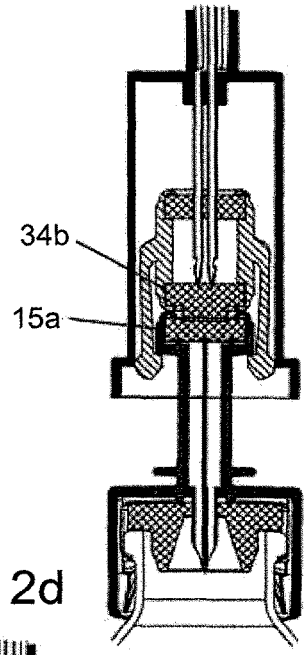
Prior Art Fig. 2c
Figure 2D:
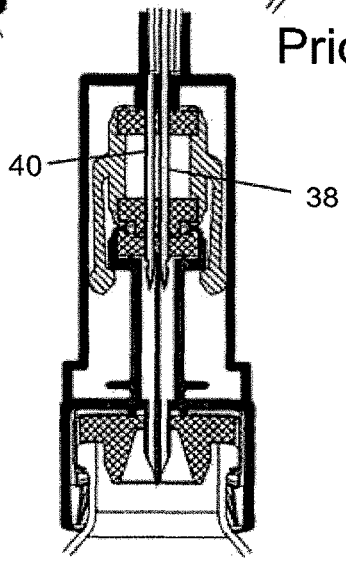
Prior Art Fig. 2d
Figure 3A:
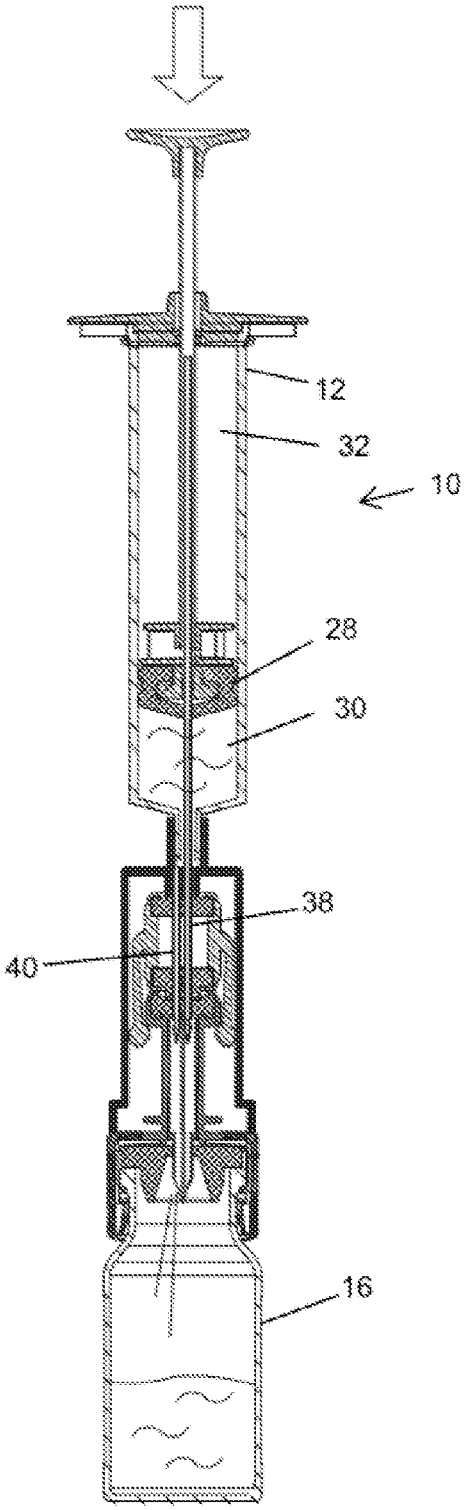
Figure 3B:
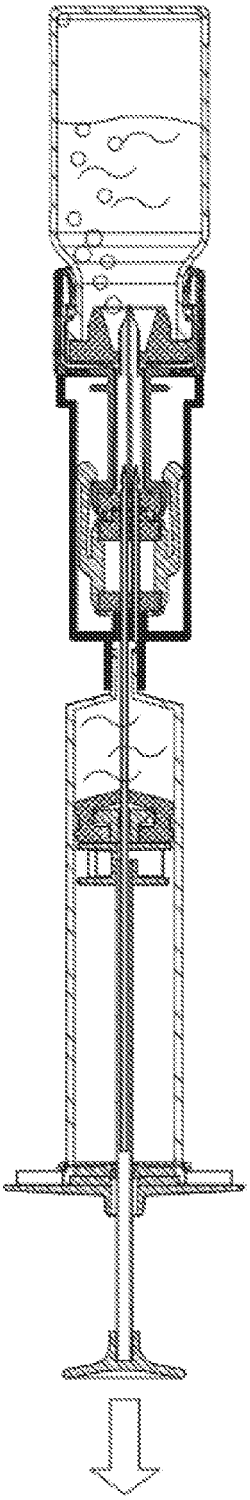

The embodiments of drug transfer apparatus shown in FIG. 1 and FIG. 2*a* do not comprise a hydrophobic filter barrier to separate the air channel from the liquid channel; therefore the method for discarding air bubbles which are naturally created during withdrawal of liquid from a vial is as follows: the bubbles are ejected from the syringe by disconnecting the vial and holding the syringe with the needles facing up, the air bubbles float naturally above the liquid in the syringe, then the plunger is depressed and the bubbles are pushed to the air chamber. For this procedure a communication between both needle ports is necessary, as exists in the embodiment of the connector 14 shown in FIG. 12.

Figure 13B:
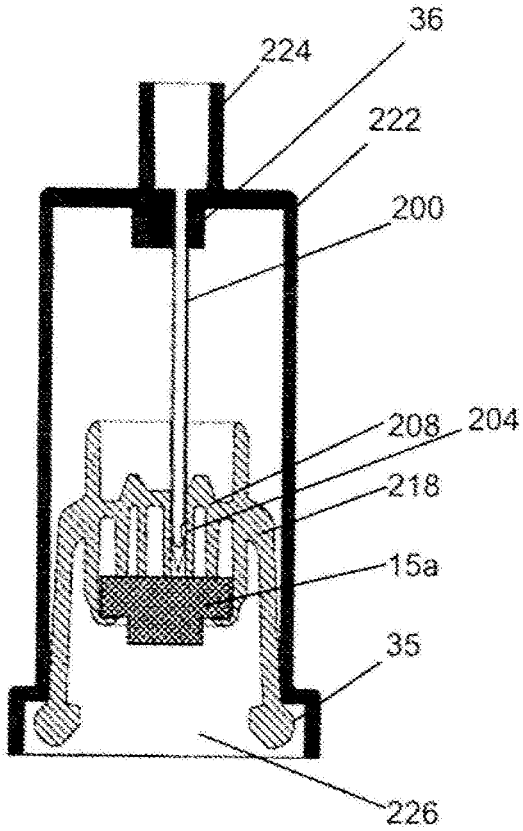
FIG. 13*b* shows the connector and adapter of FIG. 13*b* connected together.
Figure 13B:
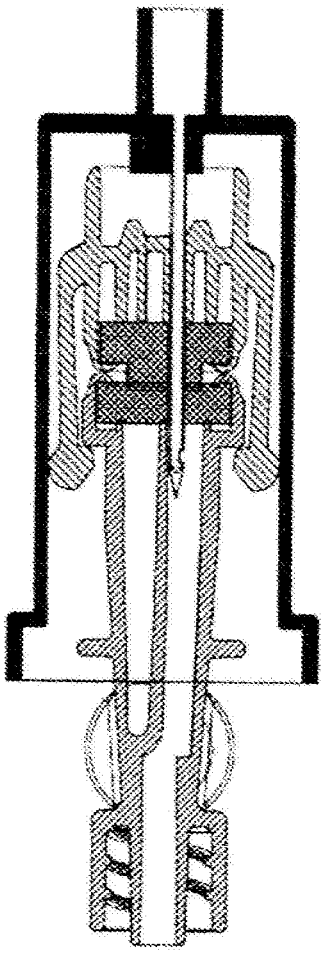
Figure 13A:
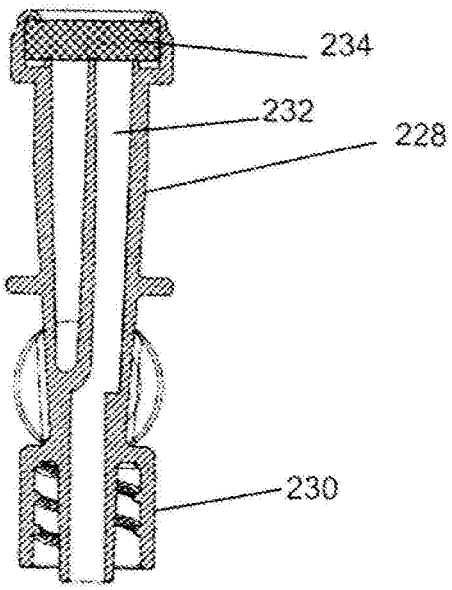
FIG. 13*a* schematically shows a connector comprising an actuator comprising a needle valve of the invention and an adapter configured to connect the connector to a component of a drug transfer apparatus.

FIG. 13*a* schematically shows a connector 222 comprising an actuator 218 comprising a needle valve of PCT/IL2014/050319 and an adapter 228 configured to connect the connector 222 to a component of a drug transfer apparatus. FIG. 13*b* shows the connector 222 and adapter 228 of FIG. 13*b* connected together.

Connector 222 comprises at its proximal end a connection port 224 e.g. a female Luer lock, adapted to be connected to a component of a drug transfer apparatus, e.g. a needless syringe or an IV tubing; a single needle 200 comprising a smooth surfaced hollow shaft and a port 204 located in the side of the shaft at the distal end close to the tip; an actuator 218 comprising the seat of a needle valve of the invention 208. A membrane 15*a* located below the seat 208, and arms 35; and an open distal end 226. The proximal end of needle 200 is fixedly attached to the housing of connector 222 by needle holder 36. The interior of the needle is in fluid communication with the interior of connection port 224. As described herein above, the needle 200 fit slidingly in the bore in seat 208 and prevents fluid from passing through the bore.

Adapter 228 comprises a membrane 234 at its proximal end, an elongated body adapted to fit into the open distal end 226 of connector 222, and at its distal end a connection port 230 e.g. a threaded male Luer lock, adapted to be connected to a component of a drug transfer apparatus, e.g. an IV tubing set. A channel 232 passes through the length of adapter 228 from below membrane 234 through connection port 230.

To connect connector 222 and adapter 228 the proximal end of the adapter is inserted into open distal end 226 of the connector and advanced until membrane 234 contacts membrane 15*a*. Further pushing of connector and adaptor together causes the tip of needle 200 out of seat of the valve 208 and through membranes 15*a* and 234 into channel 232, thereby locking connector 222 and adapter 228 together by means of arms 35, as shown in FIG. 13*b*, and establishing an open fluid path from connection port 224 on connector 222 to connection port 230 on adapter 230.

The connector shown in FIG. 13*a* like the connector shown in FIG. 10*a* through FIG. 11*b* prevents all problems associated with high pressures in general and those specifically created during accidental pushing the of plunger. As can be seen in this figure, when the connector 222 is not connected to the adapter 234, the port 204 at the distal end of needle 200 that allows exchange of fluid between the surroundings and the hollow interior of the needle is blocked by the interior of the bore in seat 208 of the needle valve. If a syringe filled or partially filled with liquid is attached to connection port 224, then no matter how much force is exerted to try to push the plunger forward and to force liquid to flow through the needle, no liquid can exit the needle through port 204. Conversely, no matter how much force is exerted to pull the plunger backwards no air can enter through port 204 and flow through the interior of the needle into the barrel of the syringe.

Figure 14:
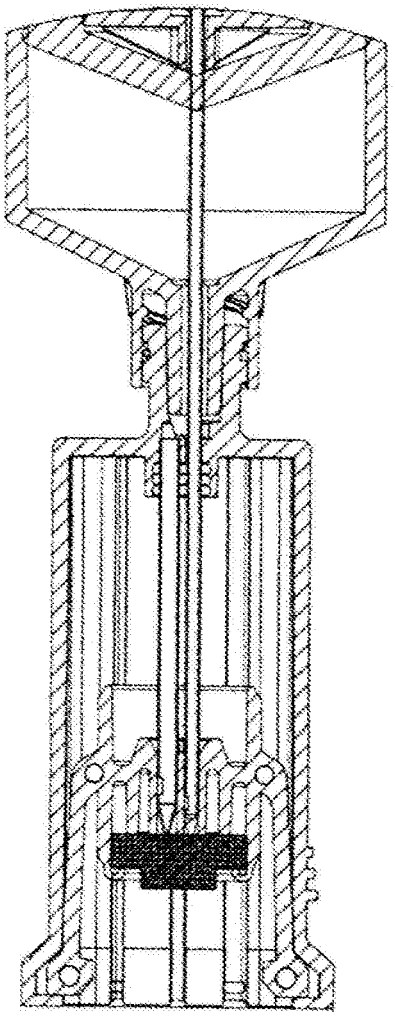
Figure 15:
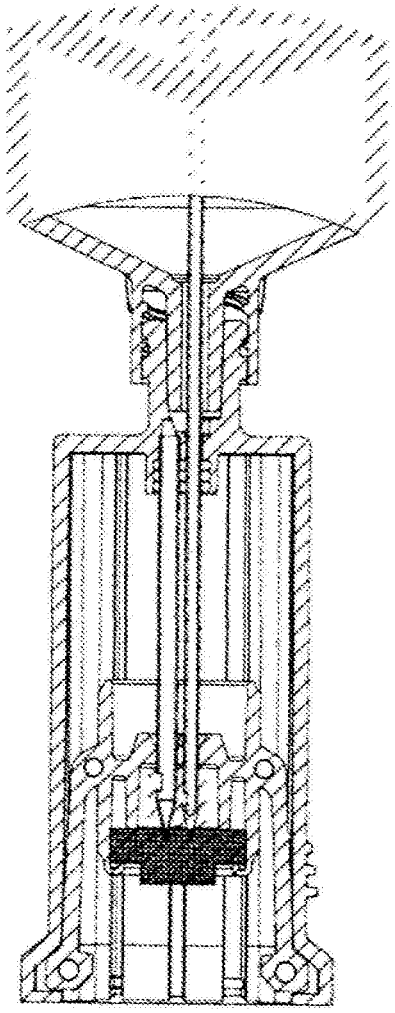

FIG. 14 and FIG. 15 are engineering drawings of two embodiments of a connector comprising needle valves according to the PCT/IL2014/050319. In the embodiment shown in FIG. 14 the ports near the tips of both the air and the liquid conduit are fully sealed and isolated from each other. In the embodiment shown in FIG. 15 the ports near the tips of the air and the liquid conduit are open to allow fluid communication between them.

Figure 16:
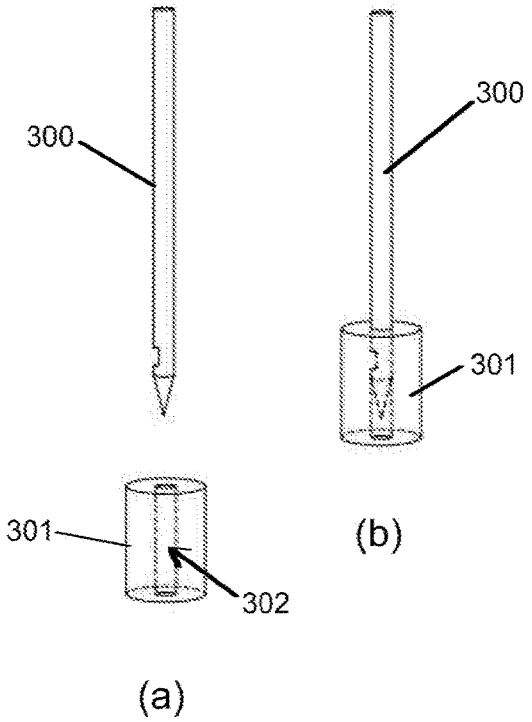
FIGS. 16 through 23 illustrate the present invention.

The invention will now be described keeping in mind the general description of this type of system provided above. FIGS. 16 (*a* and *b*) schematically illustrates a needle 300, which passes through solid member 301, which is made of a resilient material, such that the diameter of channel 302 can be slightly smaller than the outer diameter of needle 300. As will be apparent to a skilled person, each specific system may use a different tolerance in the said diameters difference, balancing between the maximal force allowed to move the needle so as to maintain user's convenience, and the pressure resistance desired of the valve to prevent leaks, so as to maintain safety.

Solid member 301 may be a sleeve that fits into a channel of larger diameter provided in the valve body, or the whole seat of the valve can be made of resilient material, such as, for instance, soft PVC, similarly to 208 in. FIG. 4. According to the invention, the material of the sleeve or seat, and the difference in diameters between needle 300 and channel 302 are selected such that that is no need to apply excessive pressure for the needle to force its way through channel 302, by pushing back the resilient material radially.

Figure 17:
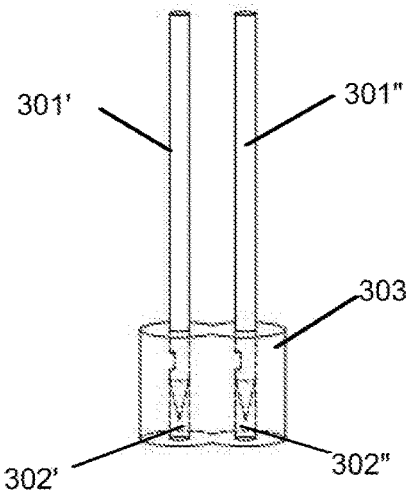

FIG. 17 illustrates the same elements adapted for use in a double valve, where to needles 301' and 301" pass through channels 302' and 302", provided in sleeve 303. In the description to follow, for the sake of brevity, whenever reference is made to a "sleeve", it should be understood that it applies mutatis mutandis to a seat made of resilient material, whenever appropriate, as hereinbefore explained.

Figure 18:
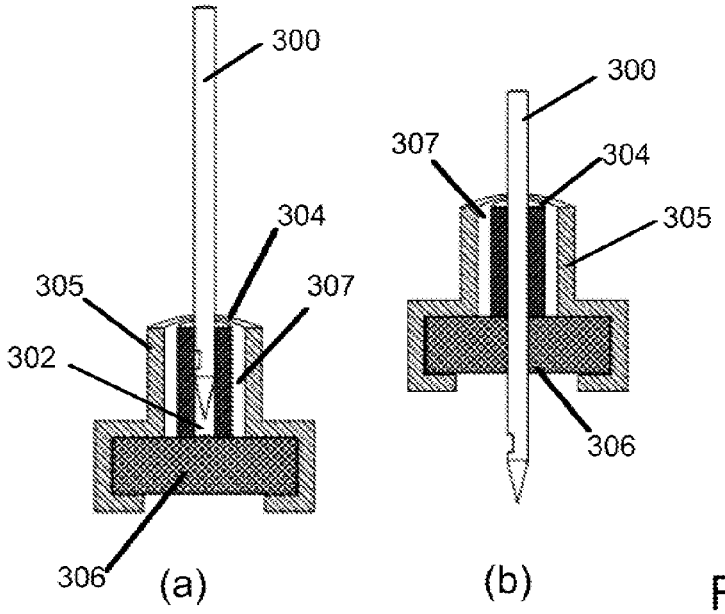

FIGS. 18 (*a* and *b*) illustrates how a sleeve 304 fits into a housing 305, a needle 300 is pushed through channel 302 of sleeve 304 and, as seen in FIG. 18(*b*), perforates membrane 306. The sleeve 304 may, in one embodiment of the invention, be kept in place by friction created by the contact of its outer surface with inner surface 307 of housing 305. The friction can be obtained simply by providing an outer diameter of sleeve 304 that is greater than the diameter of inner surface 307, which is provided in housing 305 to house sleeve 304. Thus, the resilient material of which sleeve 304 is made is compressed and pushes back toward inner surface 307. It is also possible to provide a roughening of the outer surface of sleeve 304, or to provide anchoring elements on either or both surfaces.

In another embodiment of the invention, as illustrated in FIG. 18, the outer diameter of sleeve 304 is smaller than the diameter of inner surface 307 and the two surfaces may even not touch or only loosely be in contact. In this embodiment sleeve 304 is held in place within housing 305 by membrane 306 on one side, and by a shoulder or protrusion, such as element 308 seen in FIGS. 19 and 21.

Figure 19:
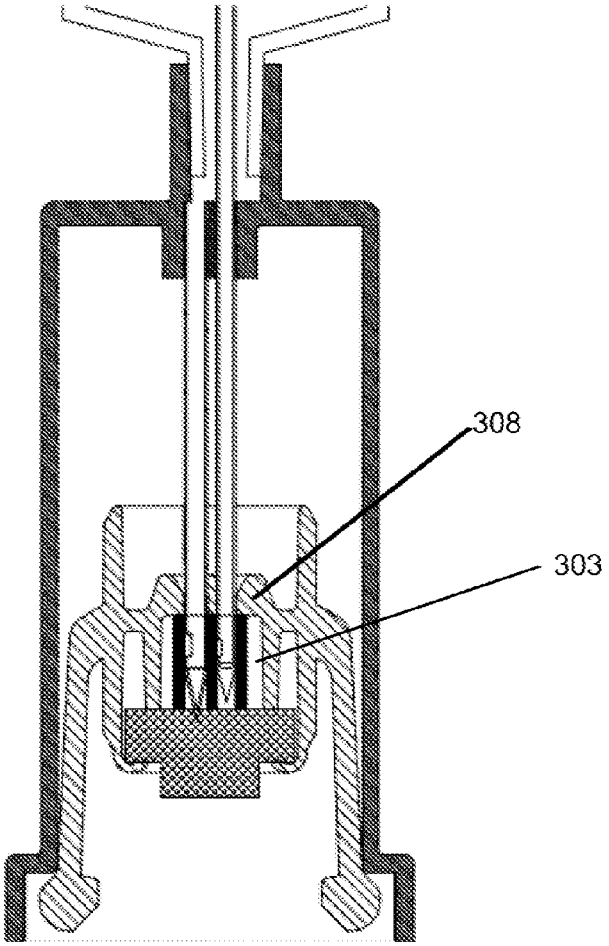
Figure 20:
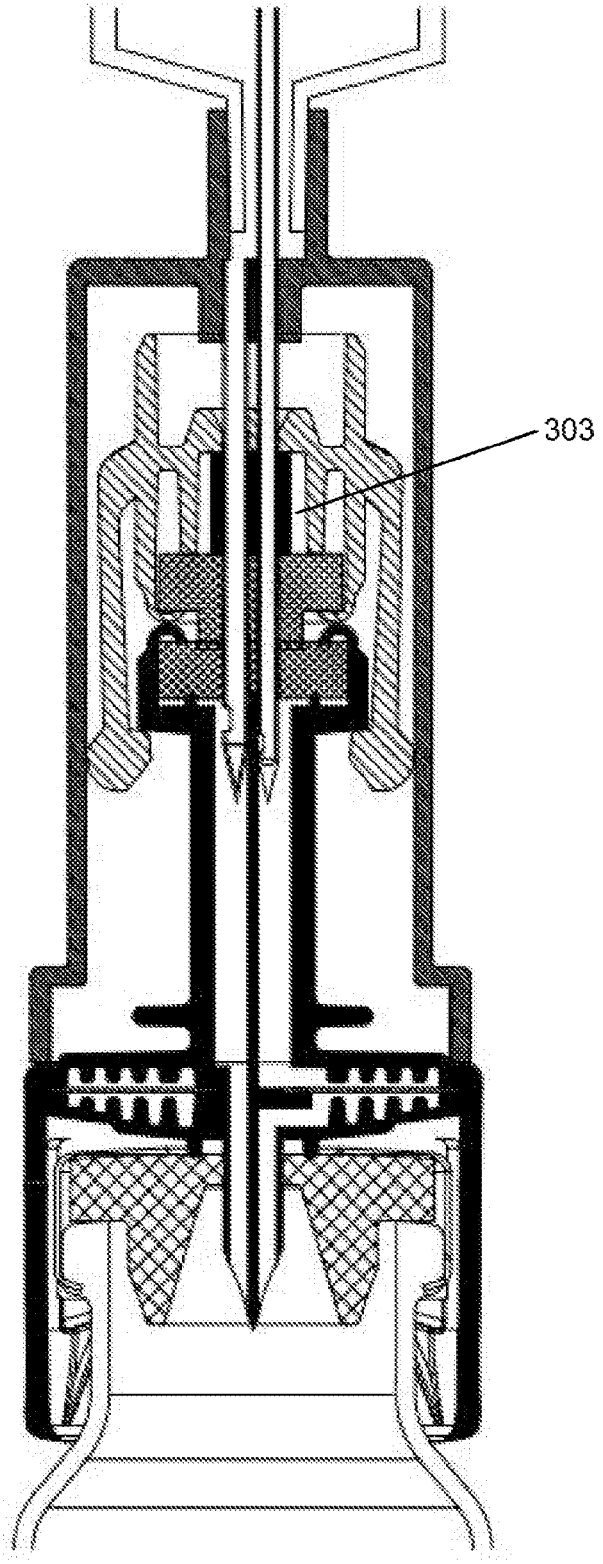

FIG. 19 illustrates how the double sleeve 303 of FIG. 17 fits into a device according to the invention. FIG. 20 schematically shows the device of FIG. 19 interconnected state.

Figure 21:
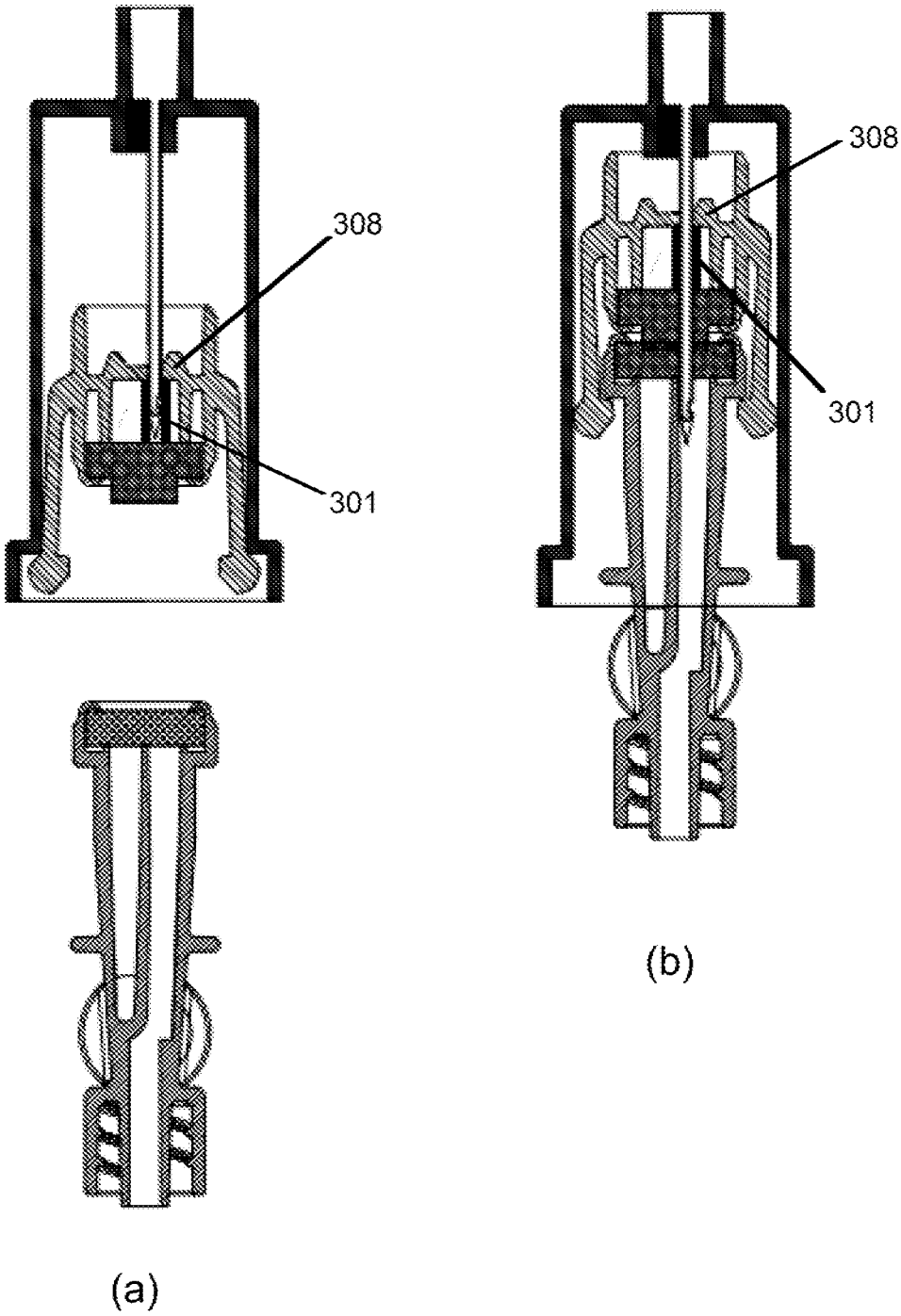

FIG. 21 shows a single needle connector with elastic needle valve using a sleeve like that of FIG. 16.

Figure 22:
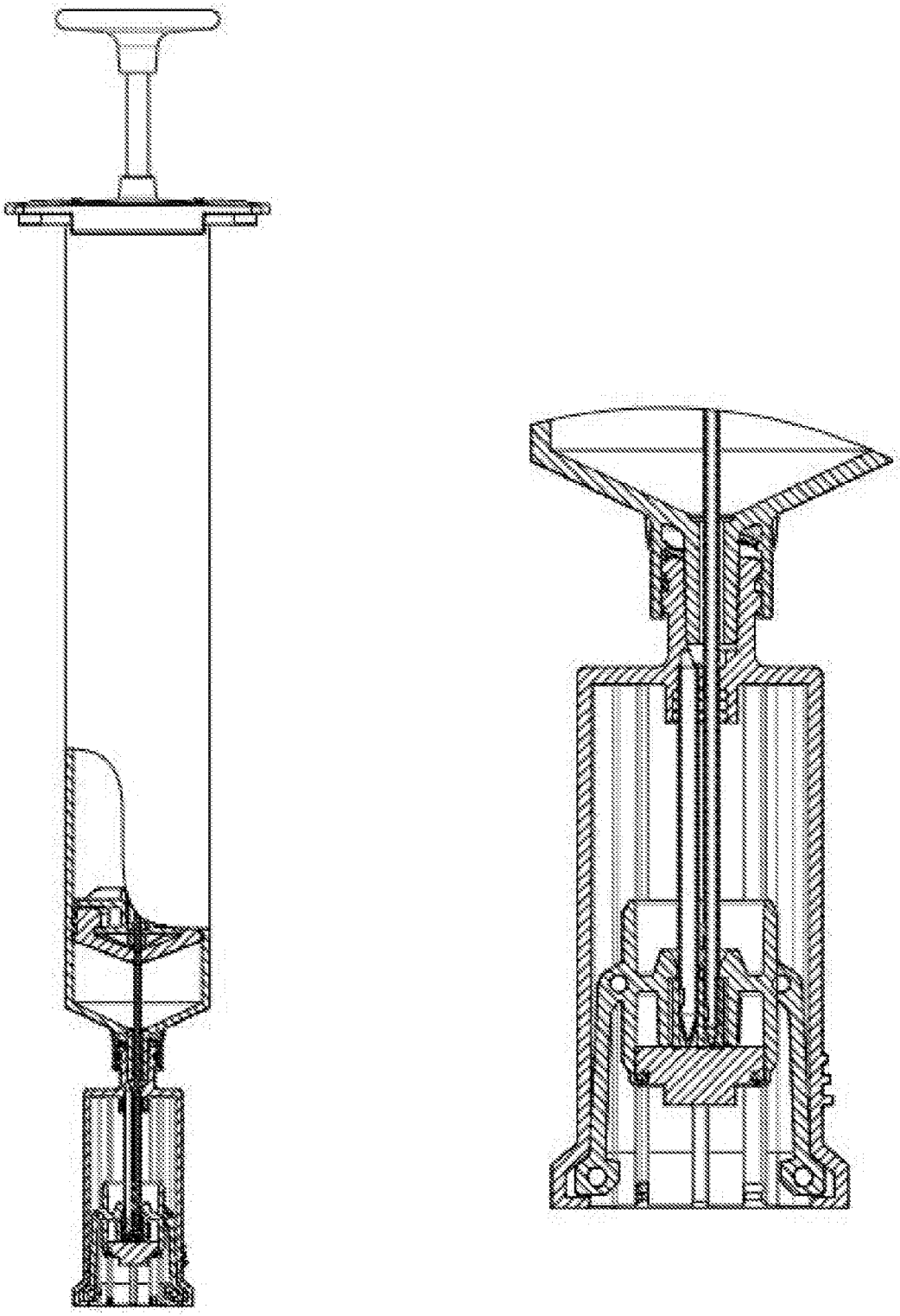
Figure 23:
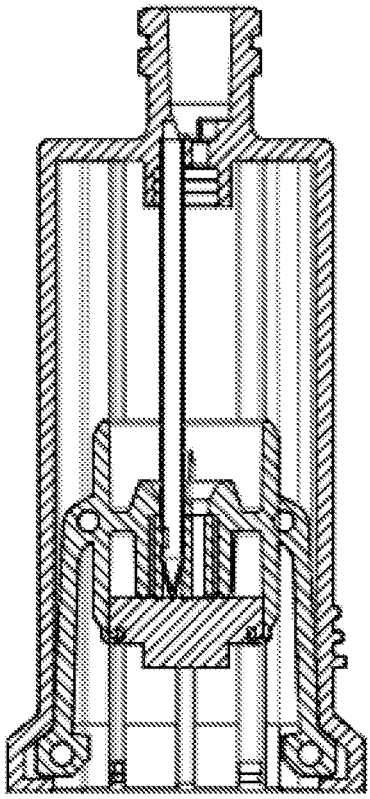

FIG. 22 shows engineering drawings of a connector with two needles and two sleeves, according to an embodiment of the invention, and FIG. 23 shows an engineering drawing of a connector with one needle and one sleeve, according to another embodiment of the invention.

The material of which the sleeve is made can be of any pharmaceutically suitable resilient material, such as silicon or rubber, but any other soft material, which can allow the needle to move through the sleeve by applying a force that creates a deformation of the channel. The elastic nature of the sleeve material ensures that proper fluid sealing is maintained.

Although embodiments of the invention have been described by way of illustration, it will be understood that the invention may be carried out with many variations, modifications, and adaptations, without exceeding the scope of the claims.

The invention claimed is:

1. A needle valve comprising:

a. at least one hollow needle having a smooth surfaced hollow shaft and a port located in the side of said shaft of said needle, said port adapted to allow fluid communication between the interior and the exterior of said needle;

b. a sleeve-shaped seat comprising at least one channel therethrough adapted to accommodate one of said at least one needles through said seat;

wherein:

i. said needle and said channel can move one relatively to the other, such that said needle can be pushed back and forth through said channel, or said channel can be moved back and forth along the needle; and ii. said channel is provided in resilient material, or is fitted in said channel with a sleeve made of resilient material, such that the outer diameter of said needle is greater than the inner diameter of at least part of said channel or of said sleeve, such that the passage of the shaft of said needle through said channel or said sleeve creates a closely-matched shaft and resilient material, which blocks the passage of fluid through said part of said channel or said sleeve and through said port.

2. The needle valve of claim 1, wherein the seat or part of it is made of resilient material.

3. The needle valve of claim 2, wherein the resilient material is silicone or rubber.

4. The needle valve of claim 1, wherein the seat is made of soft plastic material.

5. The needle valve of claim 4, wherein the plastic is soft PVC.

6. The needle valve of claim 1, comprising a lubricant for reducing the friction between the needle and the seat.

7. The needle valve of claim 1, wherein the sleeve is made of silicone or rubber.

* * * * *